US008281736B2

(12) United States Patent
Tsuchiya et al.

(10) Patent No.: US 8,281,736 B2
(45) Date of Patent: Oct. 9, 2012

(54) ADHESIVE APPLICATOR AND BOOKBINDER IN BOOKBINDING APPARATUS, AND IMAGE-FORMING SYSTEM ASSOCIATED THEREWITH

(75) Inventors: Atsushi Tsuchiya, Minami-Alps (JP); Katsumasa Takagi, Kofu (JP)

(73) Assignee: Nisca Corporation, Minamikoma-gun (JP)

( * ) Notice: Subject to any disclaimer, the term of this patent is extended or adjusted under 35 U.S.C. 154(b) by 907 days.

(21) Appl. No.: 12/324,884

(22) Filed: Nov. 27, 2008

(65) Prior Publication Data

US 2009/0133619 A1 May 28, 2009

(30) Foreign Application Priority Data

Nov. 27, 2007 (JP) ..... 2007-305739

(51) Int. Cl.
*B05C 1/08* (2006.01)

(52) U.S. Cl. ..... 118/244; 118/259; 118/261; 118/693; 118/694; 156/578; 156/908; 412/8; 412/33; 412/37

(58) Field of Classification Search ..... 118/203, 118/244, 259, 261, 693, 694; 156/578, 908; 412/8, 33, 37
See application file for complete search history.

(56) References Cited

U.S. PATENT DOCUMENTS 4,925,354 A * 5/1990 Cote ..... 412/8
5,250,318 A * 10/1993 Tooker ..... 427/8
7,814,860 B2 * 10/2010 Cerciello ..... 118/262
2007/0122256 A1 * 5/2007 Toyoizumi et al. ..... 412/37

FOREIGN PATENT DOCUMENTS

JP 2007-076118 A 3/2007

* cited by examiner

*Primary Examiner* — Laura Edwards
(74) *Attorney, Agent, or Firm* — Judge Patent Associates

(57) ABSTRACT

Bookbinding-unit adhesive application device that does not interrupt the unit to replenish adhesive when consecutively applying adhesive to sheet bundles, and can shorten the time the system is interrupted. An adhesive storage container (10) that stores adhesive; an applicator roller (30) rotatably disposed in the adhesive storage container (10); an adhesive supplier (55) that refills hot-melt adhesive to the adhesive storage container (10); heater (20) that melts the adhesive in the adhesive storage container (10); and refill volume controller (62) that controls the amount of refill adhesive of the adhesive supplier (55) are provided. The refill volume controller (61) is configured to set the adhesive refill volume based on information from adhesive detector (22*a*) disposed in the adhesive storage container (10); and remaining sheets determiner (62) that determines the number of sheets to coat for the sheet bundles to be coated with adhesive.

9 Claims, 12 Drawing Sheets

ADHESIVE APPLICATOR AND BOOKBINDER IN BOOKBINDING APPARATUS, AND IMAGE-FORMING SYSTEM ASSOCIATED THEREWITH

BACKGROUND OF THE INVENTION

1. Technical Field

The present invention, involving adhesive applicators associated with bookbinders and bookbinders employing adhesive applicators, relates to improvements in adhesive application mechanisms for applying hot-melt adhesive to the spine-portion endface of sheet bundles collated into block form.

2. Description of the Related Art

Generally, this kind of adhesive application device is widely known to collate into a bundle shape sheets conveyed from an image-forming apparatus or the like and hold that bundle at a predetermined adhesive application position. It is equipped with an adhesive container that applies adhesive to a bottom edge of the sheet bundle (the spine binding portion) and to coat an adhesive roller disposed in this container with adhesive for application. A method is also widely used to store hot-melt adhesive in the adhesive container and to melt it with heating means.

For example, a device that has an adhesive container below the sheet bundle held in an upright posture and applies a predetermined amount of adhesive using an applicator roller while moving this container along the spine binding edge of the sheet bundle is proposed in Japanese Unexamined Pat. App. Pub. No. 2007-76118. In this publication, a refilling mechanism that supplies solid-form adhesive to the container and a device that is equipped with heating means to melt the solid-form adhesive charged into this container.

It is necessary to refill the adhesive when the system is designed to store hot-melt adhesive in the container and to use heat to melt the adhesive for application. The container is configured to be large. To refill a large amount of adhesive at one time, there is the problem that it takes a long time to melt the charged adhesive. This problem causes the dropping of the adhesive temperature which can cause the adhesive in the container to harden or becoming semi-hardened (gel-form) when the machine is not being used or between applications of adhesive.

Here, Pat. App. Pub. No. 2007-76118 proposes a comparatively small and compact container that stores the adhesive and a device that supplied the adhesive according to the status of adhesive consumption in the device. In this publication, a refilling mechanism has a sensor to detect the amount of adhesive in the container and supply a predetermined amount of solid-form adhesive to the container according to detection signals from this sensor.

Conventionally, regardless of the volume of the adhesive container, this sensor detects that the adhesive in the container has been consumed below a predetermined level. The system is configured to charge a preset amount (fixed amount) of adhesive at the detection signals from this sensor. Normally, this sensor detects a state (near-empty) just prior to the adhesive in the container becoming empty. After the adhesive application in the finishing process is ended, adhesive is charged into the container for the next adhesive application process.

As described above, a sensor (level sensor) is provided to detect the amount of adhesive in the adhesive container, and when refilling adhesive at a signal, conventionally, the sensor detects a near-empty state and after the detection, and the predetermined application operation (finishing operation) is ended, a predetermined amount of adhesive is charged into the container.

In such a case, if the container is configured to be large, the amount of adhesive to refill is higher and melting requires more time. Also, if the container is configured to be compact, the melting time is shorter, but the adhesive must be refilled more frequently.

Meanwhile, the amount of adhesive consumed greatly varies depending on the size and thickness of the sheet bundle to be coated with adhesive. For example, when the bookbinding device binds a maximum size of 100 sheets in the sheet bundle, the amount of adhesive consumed for 10 sheets 1/10 the total amount. Even if the number of copies to be coated with adhesive consecutively cannot be determined uniformly because there are times when there are 10 copies, or when there are as many as 100 copies.

Conventionally, the refilling of adhesive to the container was set in the following way. First, the maximum and minimum levels of adhesive in the container were set when the unit is designed. Then, when a sensor that detects when the adhesive amount has reached the minimum level, the application operation is set to be completed when it detects a near-empty state. In other words, the adhesive amount when in a near-empty state is set to be able to apply adhesive at least one time when the sheet bundle is a maximum size, and the thickness is the maximum sheet bundle thickness. The system is set so that the refilling amount of adhesive to the container is the maximum level when the adhesive in the container is consumed to the minimum level so that the adhesive does not exceed the maximum level and overflow the container.

In this way, the following problems were created with the conventional adhesive refilling method. When the near-empty sensor has detected that the adhesive is at a minimum level, the adhesive amount control means refills a predetermined amount of adhesive to the container and sets it to the maximum level of the container when the process to apply adhesive to the sheet bundle being coated part way is ended. For that reason, the system must wait until the adhesive reaches a predetermined temperature to continue applying adhesive to subsequent sheet bundles. However, even though the amount of adhesive remaining in the container is adequate if the subsequent sheet bundle is a low number of copies, for example one sheet bundle, the system is interrupted to refill the adhesive.

If the maximum sheet bundle thickness for that unit is 100 sheets, and the system is set to be able to apply adhesive for 100 sheets after the near-empty state is detected, and the actual sheet bundle is 10 sheets, it is possible to continue applying adhesive to 10 sheet bundles with the amount of adhesive remaining in the container. In such a case, when the number of sheet bundles to be subsequently processed is less than 10 copies, even though it is possible to continue applying adhesive, the system is interrupted to refill the adhesive.

Also, when the sensor detects a near-empty state, even if the subsequent number of sheet bundles is low, conventionally, a predetermined amount of adhesive is refilled to reach the maximum level. Therefore, even if the insufficient adhesive is enough for one sheet bundle, a predetermined amount of adhesive is refilled, so there is the problem of requiring a longer amount of waiting time to refill the adhesive (melting time when using hot-melt adhesive).

This problem occurs frequently if the size of the container is smaller, and if the container is larger, the frequency of the problem is lower, but the time required to wait for the refilling of adhesive is longer. Even if the container is configured to be large or small, the conventional method to refill adhesive has the problem of an unnecessarily long wait for processing because adhesive is refilled until the maximum level regardless of the number of sheet bundles, the size and the bundle thickness when the sensor has detected a near-empty state.

BRIEF SUMMARY OF THE INVENTION

The inventors came upon the idea of solving the aforementioned problems by refilling adhesive according to the amount consumed by subsequent sheet bundles.

An object of the present invention is to provide an adhesive application device in a bookbinding unit that does not interrupt a device to refill adhesive when consecutively applying adhesive to sheet bundles with an applicator roller and the like, and can shorten the time the system is interrupted.

Furthermore, the present invention provides a bookbinding device and image-forming system that improve the system operating rate by accurately setting the number of refills of adhesive and the refilling time with a simple structure.

In a device configuration that disposes adhesive supply means for supply adhesive to the adhesive container and refill amount control means that controls the amount of refill adhesive, to overcome the aforementioned issues, the present invention is configured to set the amount of refill adhesive based on information from adhesive amount detection means with the refill amount control means in the container and remaining sheets determining means that determines the number of sheets in a sheet bundle to be coated with adhesive. The configuration will be explained in detail below.

An adhesive application device that sequentially applies adhesive to a spine portion of continuously supplied sheet bundles has an adhesive storage container (10) that stores adhesive; an applicator roller (30) rotatably disposed in the adhesive storage container (10); an adhesive supply means (55) that refills hot-melt adhesive to the adhesive storage container (10); heating means (20) that melts the adhesive in the adhesive storage container (10); and refill volume control means (61) that controls the amount of refill adhesive of the adhesive supply means (55). The refill volume control means (61) is configured to set the amount of refill adhesive based on information from adhesive detection means (22*a*) disposed in the adhesive storage container (10); and remaining sheets determining means (62) that determines the number of sheets to coat of the sheet bundle to be coated with adhesive.

The remaining sheets determining means (62) is configured to determine the number of completed applications of the sheet bundle coated with adhesive by the applicator roller (30) and the number of applications of the empty sheet bundle.

The refill volume control means (61) has a scheduled consumption-volume calculation means (64) that calculates a scheduled adhesive-consumption volume from the count, from the remaining sheets determining means (62), of sheet-bundle adhesive applications remaining, and from the application volume of adhesive applied to a single sheet bundle.

The refill volume control means (61) has comparing means (65) that compare the preset refill amount and the scheduled consumption amount from the scheduled consumption amount calculation means (64). Also, when the scheduled consumption amount is detected to be lower than the set refill mount by the comparing means (65), the adhesive refilling amount is set based on this set consumption amount.

The scheduled consumption amount calculation means (64) is configured to calculate the scheduled consumption amount of adhesive from the remaining number of applications of the sheet bundle and either from (1) the preset application amount to be applied to one sheet bundle, or (2) the application amount of adhesive to be applied to one sheet bundle calculated from information such as the size of the remaining sheet bundles, the number of sheets, the sheet bundle thickness and material and the like.

The refill volume control means (61) has a plurality of set refill amounts that differ for the preset adhesive amount, and this refill volume control means (61) refills adhesive to the adhesive container (10) by selecting one of the set refill amounts based on information from the remaining sheets determining means (62).

The bookbinding device according to the present invention is equipped with a sheet bundle conveyance path (hereinafter referred to as a bookbinding path 47) that sequentially conveys a collated and stacked sheet bundle; an adhesive application unit disposed in the bookbinding path 47 that applies adhesive to a spine portion of the sheet bundle; and total number of sheets processed recognition means that determines the total number of subsequent sheet bundles. The adhesive application unit is configured as described above.

Stacking means (hereinafter referred to as a stacking tray 44) for collating and stacking sequentially conveyed sheets into a sheet bundle is disposed in the bookbinding path 47; the refill volume control means (61) charges adhesive to the adhesive container (10) based on a detection signal from the adhesive amount detection means (22*a*) and on information from the remaining sheets determining means (62) in the time that the later sheets are being stacked in the stacking means (stacking tray 44).

The total number of sheets processed recognition means is configured to ascertain information using input information from input means that inputs the total number of sheet bundles to process or information transferred from another device.

Sheet stacking means (hereinafter referred to as stacking tray 44) that collates sheets into sheet bundles is disposed upstream of the bookbinding path 47. The heating means (20) is configured to melt the adhesive filled from the adhesive supply means (55) while the sheets are being stacked by the stacking tray 44.

The image-forming system according to the present invention is composed of an image-forming device that has image-forming means for sequentially forming images on sheets, and a bookbinding device that collates into sheet bundles sheets conveyed from the image-forming device, coats an edge of the sheet bundle with adhesive and then binds the sheet bundle to a cover sheet; the bookbinding device is configured as described above.

The present invention has the following effects when adhesive is supplied to the adhesive storage container because it sets the adhesive refilling amount based on information from the adhesive amount detection means in the container and remaining sheets determining means that determines the remaining number of applications to the sheet bundle.

First, it is possible to set the adhesive refilling amount to be low if the remaining number of sheets to be coated with adhesive is low, and to be high if the remaining number of sheets to be coated with adhesive is high, by setting the refilling amount based on the information of the remaining number of sheets, and the detection signals from the adhesive amount detection means. For this reason, it is particularly possible to shorten the time needed to refill the adhesive when the remaining number of applications is low.

The present invention can set the refill amount based on the detection signals from the detection means of the adhesive in the container and information from the remaining number of applications of the sheet bundle, so it is possible to continue applying adhesive without refilling adhesive when it is possible to apply adhesive to the remaining sheet bundles with the adhesive remaining in the container.

Furthermore, the present invention can refill adhesive to the minimum required by refilling the adhesive according to the scheduled consumption amount by calculating the consumption amount of adhesive from the next sheet bundle thickness (or information on the number of sheets), the sheet sizes, and materials and the like, based on remaining number of applications information. For that reason, it is possible to shorten the time required to refill the adhesive (the melting time for hot-melt adhesive) and not leave a large amount of adhesive in the container when machine operation is ended. Therefore, when changing the adhesive for the bookbinding specifications, it is easy to remove the residual adhesive.

BRIEF DESCRIPTION OF THE SEVERAL VIEWS OF THE DRAWINGS

FIG. 1A is a perspective view of the external shape of the unit; FIG. 1B is a sectional view in an X-X direction; FIG. 1C is a sectional view in a Y-Y direction;

FIG. 2A shows an overall configuration thereof; FIG. 2B shows a measuring mechanism to measure the adhesive refilling amount;

FIG. 8A is an explanatory control-process flowchart indicating adhesive refilling operations in the device of FIG. 1, while

FIG. 9 is a detailed flowchart of adhesive refilling in the control flow of FIG. 8.

DETAILED DESCRIPTION OF THE INVENTION

Figure 1A:
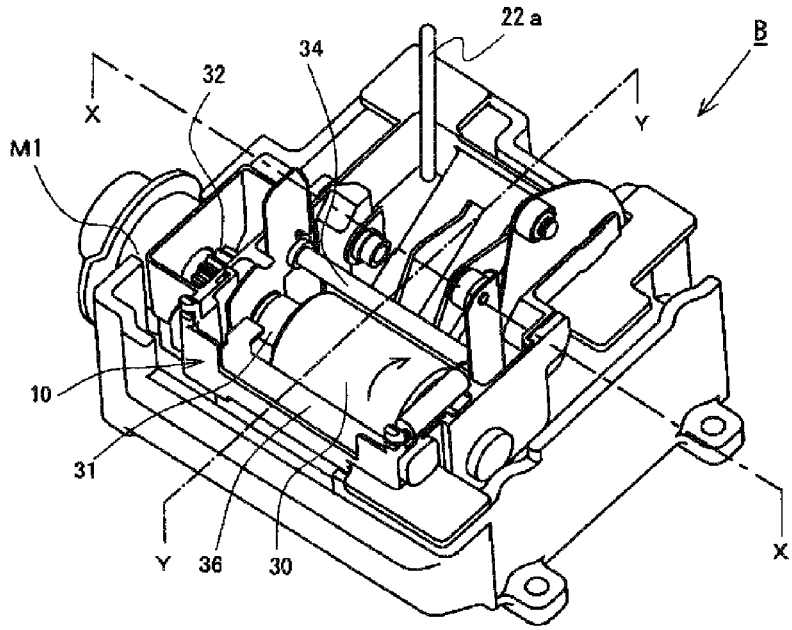
FIGS. 1A to 1C are explanatory views of an adhesive application device (unit) used in a bookbinding device according to the present invention.
Figure 1B:
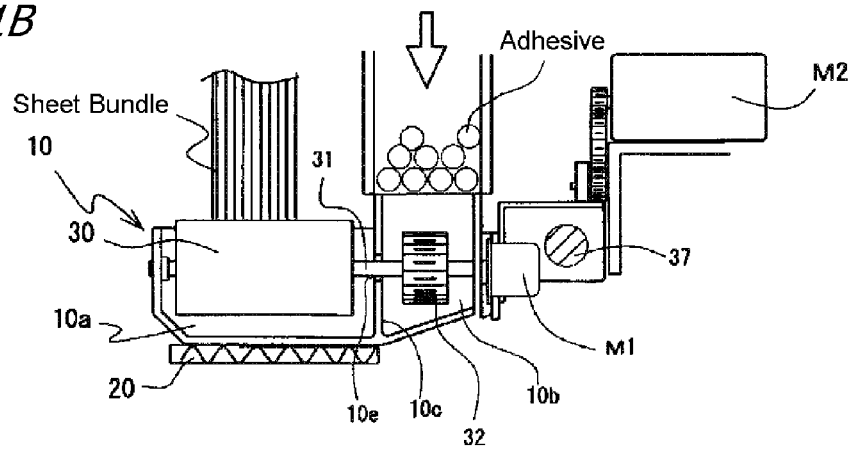
Figure 1C:
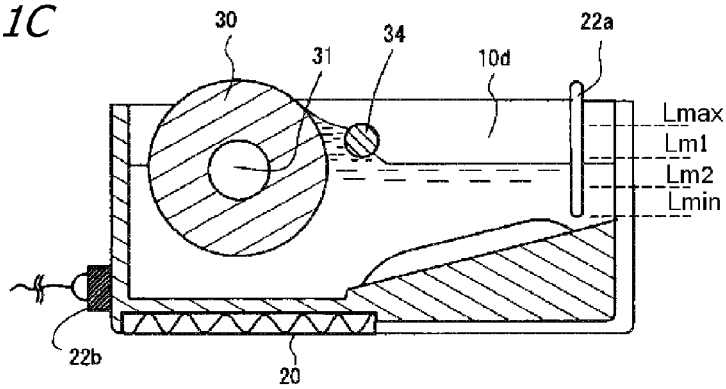
Figure 3:
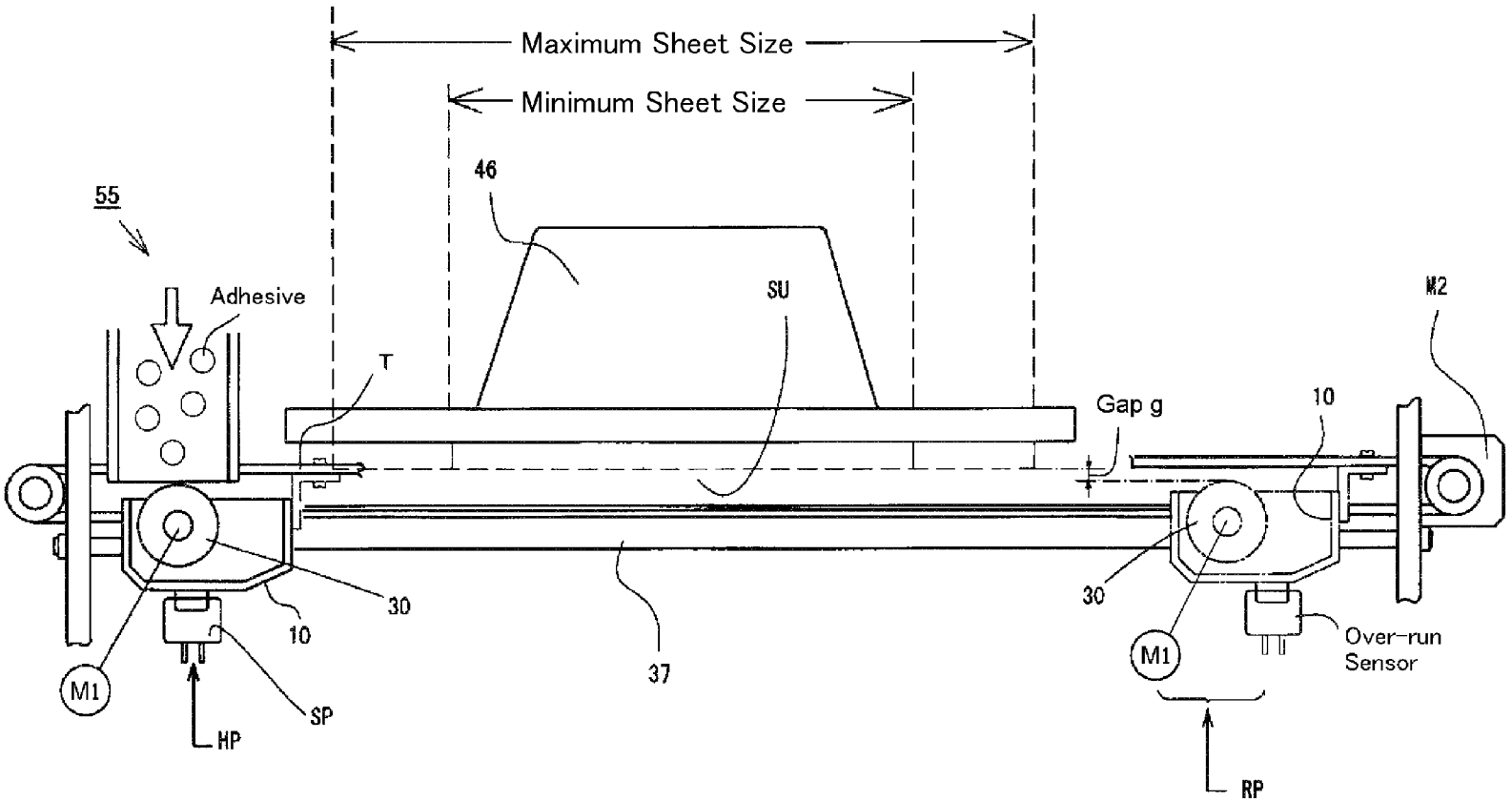
FIG. 3 is an explanatory drawing of an application mechanism that applies adhesive to a sheet bundle with the adhesive application device of FIG. 1.
Figure 4:
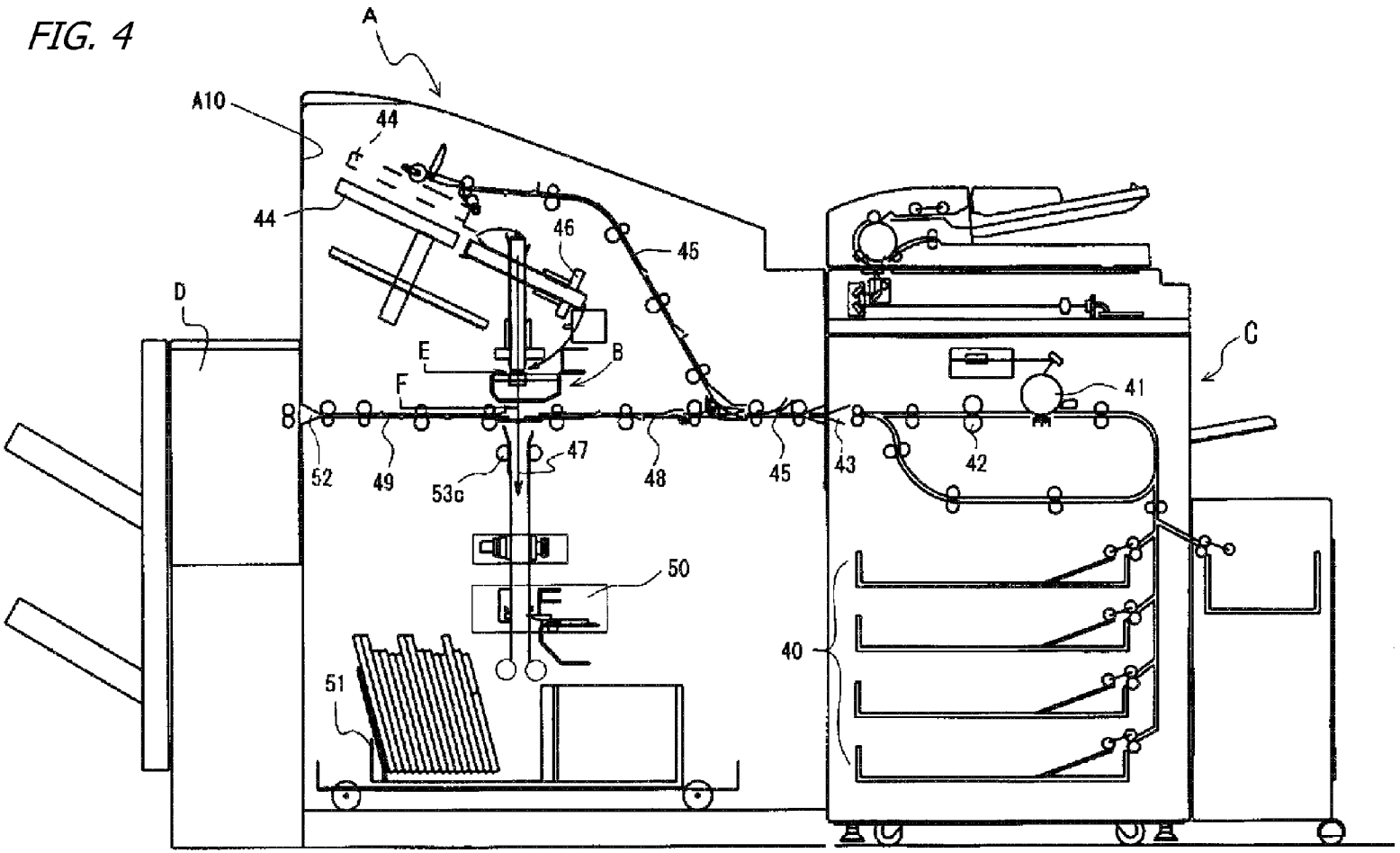
FIG. 4 is an overall explanatory view of an image-forming system installed with the adhesive application unit.
Figure 5:
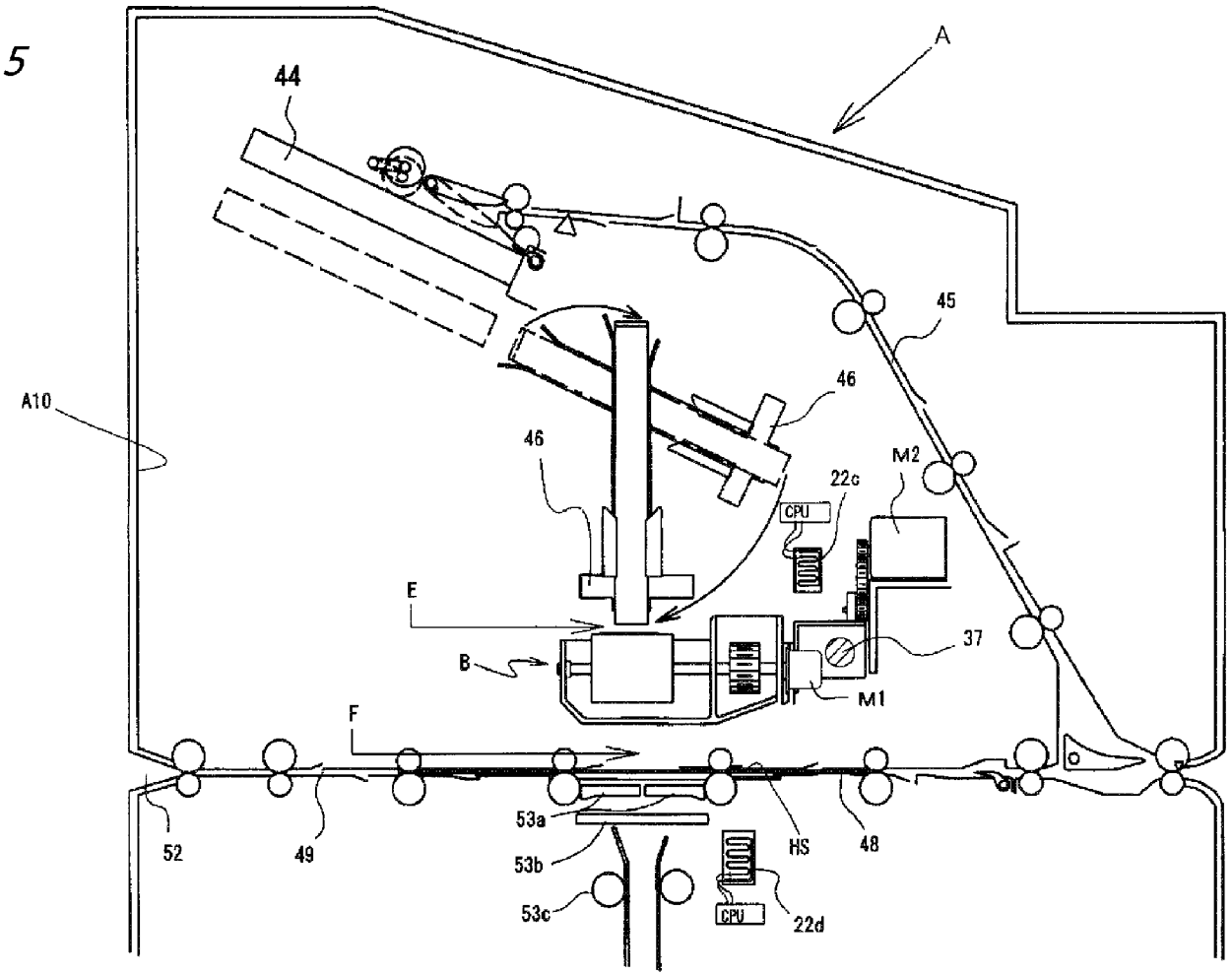
FIG. 5 is an explanatory view showing in detail the bookbinding unit in the system shown in FIG. 4.

A preferred embodiment of the present invention will now be explained based on the drawings provided. An adhesive application unit B built-in to the bookbinding unit of the present invention will now be explained with reference to FIGS. 1 to 3. FIG. 1 is an explanatory drawing showing a structure of the adhesive container that stores solid adhesive. FIG. 1A is a perspective view; 1B is an X-X sectional view; 1C is a Y-Y sectional view. FIG. 4 is an overall view of bookbinding unit with a built-in adhesive application unit and an image-forming system. FIG. 5 is a view of the essential portion of the bookbinding unit shown in FIG. 4.

Adhesive Application Unit Configuration

The adhesive application unit B shown in FIG. 1A is composed of an adhesive container 10 (hereinafter referred to as "container") that stores adhesive; an applicator roller 30 that applies liquefied adhesive to a sheet bundle; and heating means 20 mounted inside the container to melt adhesive. The adhesive container 10 is partitioned into a solid adhesive charging compartment 10*b* (hereinafter referred to as the charging compartment) and a liquefied adhesive tub 10*a* (hereinafter referred to as adhesive tub) by a partition 10*c*; a connecting opening 10*e* is provided in the partition 10*c* to allow the adhesive liquefied at the charging compartment 10*b* to flow into the adhesive tub 10*a*. This adhesive container 10 is composed of a tub-shaped tray comprising the charging compartment 10*b* and adhesive tub 10*a* and either formed from a material with high thermal-conductivity properties such as metal and the like, or a material with high workability properties such as resin and the like. A thermally conductive plate such as metal and the like is laid at the bottom surface.

The applicator roller 30 is rotatably supported in the adhesive tub 10*a*. The applicator roller 30 is formed by a heat-resistant rubber material that has a superior impregnating property. The upper half of the applicator roller 30 projects upward from the adhesive tub 10*a*, and the lower half is disposed to be submerged in the liquefied adhesive in the adhesive tub 10*a*. (See FIG. 1C) Therefore, liquefied adhesive impregnates the applicator roller 30 at the lower half of the roller by the applicator roller 30 rotating. The upper half, projecting upward, applies the liquefied adhesive to the sheet bundle. A rotating shaft 31 of the applicator roller 30 is arranged longitudinally to the charging compartment 10*b* via the connecting opening 10*e*, and a stirring gear 32 that stirs the adhesive in the charging compartment 10*b* is mounted to this rotating shaft 31.

A forward and reverse-rotating motor (hereinafter called a stirring motor) M1 is connected to the rotating shaft 31. Therefore, the applicator roller 30 and stirring gear 32 are rotated by the rotational drive of the stirring motor M1. The applicator roller 30 stirs the adhesive in the adhesive tub 10*a*, and the stirring gear 32 stirs the adhesive in the charging compartment 10*b*. 10*d* in FIG. 1C denotes a liquid adhesive holding portion disposed in the adhesive container 10*a*. This forms a basin to supply adhesive to the applicator roller 30 at a stable temperature so there is always an adequate amount of adhesive.

An adhesive sensor 22*a* (hereinafter called adhesive amount detection means) is disposed in the liquid adhesive holding portion 10*d* to detect the temperature and amount of the liquefied adhesive. 22*a* in the drawing denotes a rod-shaped thermistor. This is disposed in the liquid adhesive holding portion 10*d* separated from the applicator roller 30. This thermistor is composed of sintered fine-ceramic semiconductor heat-sensitive elements that use a variety of transition metal oxide materials such as Mn, Co, Ni, Fe, Cu and the like as the raw material.

The adhesive sensor 22*a* in the drawing detects the surface of the adhesive (the remaining amount of adhesive) at the same time as detecting the temperature. In other words, this determines the amount of adhesive at a range (change of resistance value) that the detected temperature changes at the surface of the adhesive constantly heated to a temperature higher than room temperature to detect the remaining amount of adhesive. In such a case, the sensor 22*a* is disposed in the liquid adhesive holding portion 10*d* separated from the applicator roller 30 so that its detection of the surface of the adhesive is unaffected by the rotation of the applicator roller 30. The adhesive sensor 22*a* is connected to a control CPU60, described below, to detect the near-empty state of the adhesive in the container (Lmin in the drawing) and an empty state (Lmax in the drawing). Note that the adhesive amount detection means of the present invention does not need to dual as a temperature sensor, and can, for example, be composed of a liquid surface sensor such as a float structure.

Also, 34 denotes a control rod. This is disposed at a predetermined distance along an outer circumference of the applicator roller 30 in a lateral direction of the adhesive container 10. This rod is attached at a predetermined distance from the outer surface of the applicator roller 30 to produce a uniform layer of adhesive around the roller surface. The distance of the control rod 34 to the surface of the applicator roller is adjusted according to the position of the sheet bundle. 36 denotes a plate-shaped blade. This is disposed a predetermined distance (doctor gap) from the outer circumference of the applicator roller 30 to sweep away excessive adhesive adhering to the outer circumference of the roller and to make the layer of adhesive uniform.

Heating means 20 is installed in the adhesive container 10 that is configured as described above. The heating means 20 is composed of an electrically powered heater and high-frequency heating elements, and is embedded in the floor surface of the adhesive tub 10*a* of the adhesive container 10. It is acceptable for this electrically powered heater 20 (hereinafter referred to as heating means) to be disposed in at least one of either the adhesive tub 10*a* or the charging compartment 10*b*, or in both. Also, it is acceptable to dispose an extra electrically powered heater in the charging compartment 10*b* to preheat the solid adhesive.

The following will now explain heating temperature control of the heating means 20 (electrically powered heater) disposed in the adhesive tub 10*a*. Adhesive sensor 22*a*, described above, is disposed in the adhesive container 10, also described above, and this sensor is composed to detect the liquid amount and the adhesive temperature at the same time. Also, a heating unit temperature sensor 22*b* that detects the temperature of the outer wall of the container heated by the heating means 20 is disposed in the adhesive container 10. The heating unit temperature sensor 22*b* detects the temperature of the heating means, and controls the adhesive melting temperature along with the adhesive temperature sensor 22*a*. An erroneous temperature detection sensor, not shown, is disposed in the adhesive container 10. When the adhesive and the adhesive container 10 storing that adhesive are heated to an excess temperature, it turns the unit power OFF. For that reason, these sensors are connected to a control CPU60, described below (see FIG. 10).

Adhesive Application Unit Configuration

The adhesive container 10 as described above has a reciprocating motion along the sheet bundle. FIG. 3 is a conceptual diagram of the container. The adhesive container 10 is formed to a shorter length (dimension) than the bottom edge of the sheet bundle (the spine binding portion) SU. The container is supported on a guide rail 37 of the apparatus frame to move along the bottom edge SU of the sheet bundle along with the applicator roller 30 installed in that container. The adhesive container 10 is connected to a timing belt T installed on the apparatus frame; a drive motor M2 is connected to the timing belt T.

Therefore, drive motor M2 reciprocates the adhesive container 10 between a home position HP and a return position RP where the return operation is started along the sheet bundle. Each position is set to the positional relationships shown in FIG. 3; the return position RP is set based on sheet width size information. The adhesive container is set to the home position HP when the power is turned on (at device initialization). For example, this moves from the home position HP to the return position RP after a predetermined amount of time after a sheet grip signal from the grip sensor Sg of the gripping conveyance means 46. At the same time as this movement, the roller stirring motor M1 starts rotating the applicator roller 30. Note that the home position sensor of the adhesive container 10 is denoted by the symbol SP in the drawing.

With the adhesive applicator unit B configured as described above, rotation of the drive motor M2 starts moving the adhesive container 10 from the left side of FIG. 3 to the right side along the guide rail 37. The amount of travel of the gripping conveyance means 46 is adjusted by the elevator motor (not shown) so that the applicator roller 30 pressingly contacts the sheet bundle to slightly separate the edges of the sheets in the advancing path, and forms a predetermined gap with the sheet bundle edge in the return path to return from the return position RP to the home position HP to apply adhesive.

Adhesive Application Unit Configuration

Adhesive supply means 55 for supplying sold-form adhesive to the charging compartment 10*b* is disposed in the adhesive container 10 home position HP. As shown in FIG. 2, the adhesive supply means 55 is provided to refill adhesive to the charging compartment 10*b* with a signal (hereinafter referred to as a near-empty signal) from the liquid amount sensor 22*a*. This adhesive supply means 55 is composed of a hopper 56 that stores adhesive formed to a spherical-shape; a measuring mechanism 57 that measures the adhesive in the hopper at the same time as conveying it; and conveying pipe 58 that conveys adhesive from the measuring mechanism 57 to the charging compartment 10*b* of the adhesive container 10.

Figure 2A:
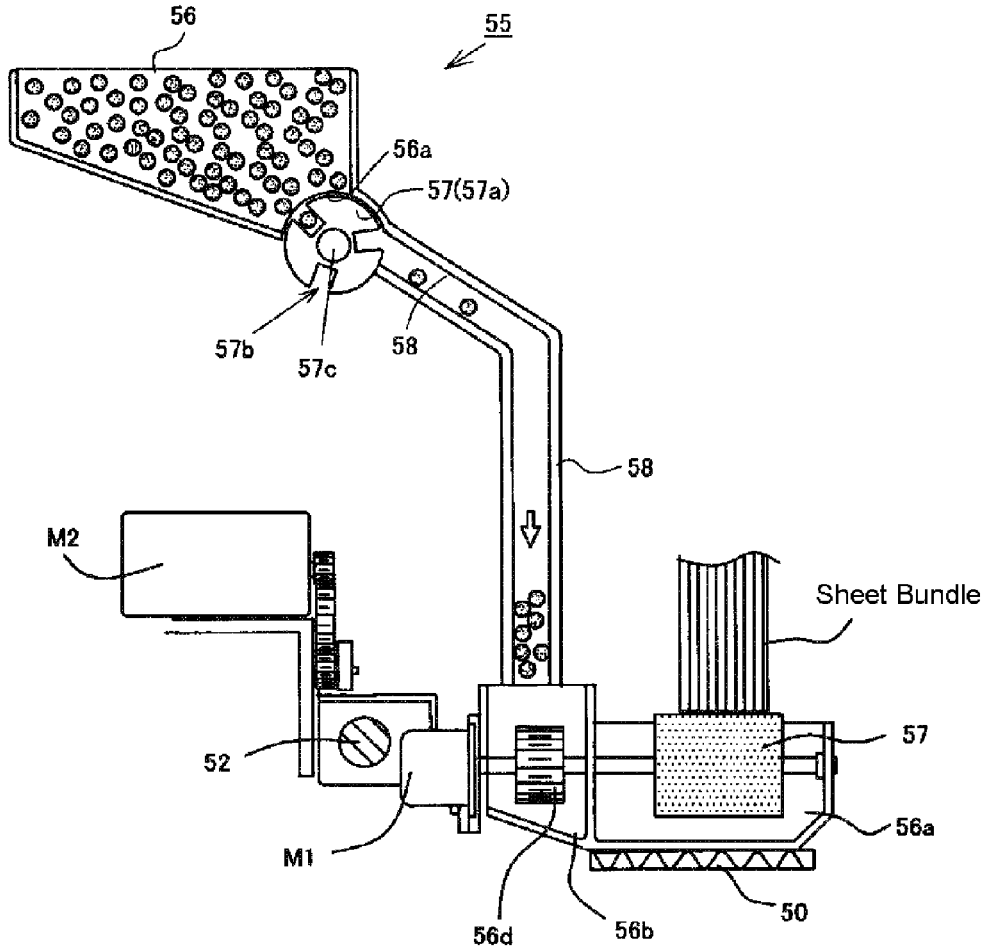
FIGS. 2A and 2B show an adhesive refilling mechanism in the adhesive application unit shown in FIG. 1.
Figure 2B:
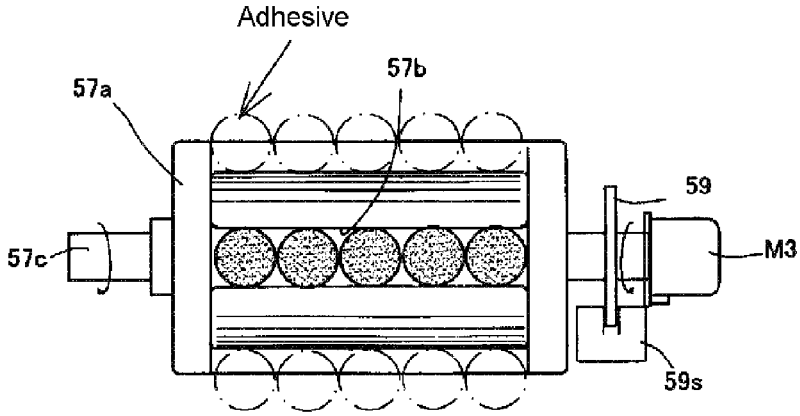

The hopper 56 is composed of a box-shape with an appropriate storage capacity, and is configured to store clumps of hot-melt adhesive inside and convey them from a conveyance outlet 56*a* on the bottom thereof. The measuring mechanism 57 is disposed in the conveyance outlet 56*a* on the bottom of the hopper, and is configured to feed adhesive from the conveyance outlet to a downstream feeding pipe while measuring the amount. One example of this structure is shown in FIGS. 2A and 2B. The measuring mechanism 57 is composed of a measuring drum 57. A measuring mechanism 57*b* that matches the outer diameter of the adhesive (the ball shapes shown in the drawing) on the outer circumference is disposed on the measuring drum 57*a*; a rotating shaft 57*c* is disposed at the center of the drum 57*a*. A control motor M3 is linked to the rotating shaft 57*c*. Measuring channels 57*b* are disposed at three positions on the circumference of the measuring drum 57. Five pieces of adhesive are stored in each measuring channel. Therefore, five pieces of adhesive are conveyed downstream when the drum 57*a* rotates ⅓; 10 pieces are conveyed downstream when the drum rotates ⅔; and 15 pieces of adhesive are conveyed downstream when the drum rotates one complete cycle. An empty sensor 59 and position sensor 59S are disposed on the rotating shaft 57*c*. A control CPU60, described below, controls the angle of rotation of the measuring drum 57*a* and the number times of its rotation to feed a predetermined amount of adhesive to a downstream conveyance pipe 58.

The conveyance pipe 58 is configured to feed adhesive from the hopper 56 to the charging compartment 10*b* positioned at the home position. It is acceptable to dispose a vacuum fan, not shown, to intake molten gas dispersed from the charging compartment 10*b*, in the conveyance pipe 58. In such a case, it is preferable to cover the conveyance outlet 56*a* at the outside wall of the measuring drum 57*a* so that molten gas does not enter the hopper 56.

Adhesive Refilling Control Means Configuration

Detection signals from the adhesive sensor 22*a* disposed in the adhesive container 10 and from the position sensor 59S on the measuring drum 57*a* are transmitted to the control CPU60, but refill volume control means 61 are configured as described below with the control CPU60. A feature of the present invention is to set the adhesive refilling amount according to the number of applications of sheet bundles when the adhesive sensor 22*a* detects a near-empty state, when the refill volume control means 61 is continuously applying adhesive to sheet bundles.

Figure 8A:
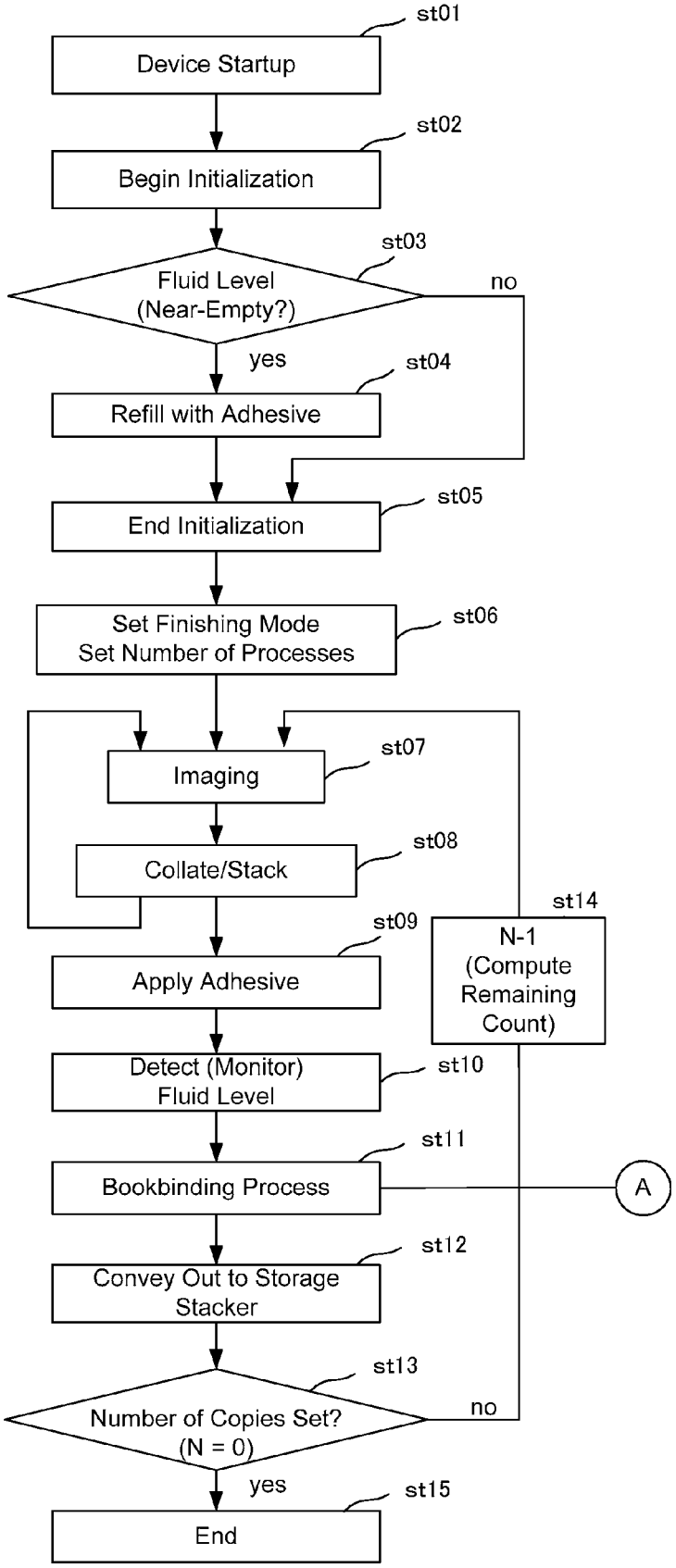
Figure 8B:
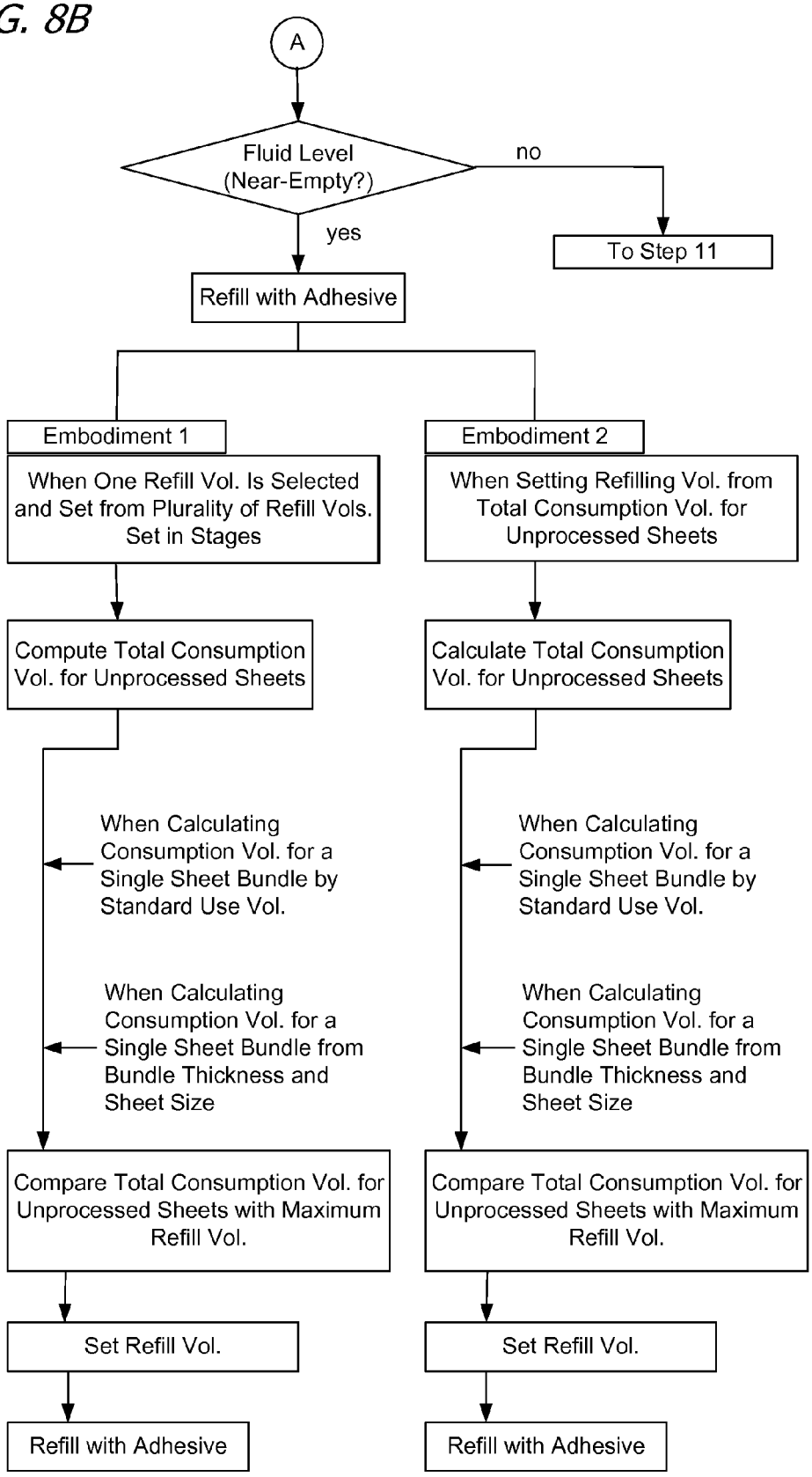
FIG. 8B is a flowchart outlining adhesive refill-volume-setting processes in two embodiments, as carried out at the bookbinding process step in FIG. 8A.

The following will now explain the refill volume control means 61 with reference to the refill control flow chart shown in FIG. 8. When the system is started (St01), the initialization operation is executed (St02). This initialization operation sets the activating units of the system to their preset initial states. For example, the adhesive container 10 is positioned at its home position HP by the signal from a sensor Sp. At the same time as the initializing of the activating units, heating means 20 raises the temperature of the adhesive in the adhesive container 10 to a predetermined degree (a temperature higher than the melting point of the adhesive). This is to set the adhesive remaining in the adhesive tub 10*a* of the adhesive container 10 to a predetermined melting temperature to change it from a solid state to a gel state.

Here, the adhesive sensor 22*a* determines whether the adhesive container 10 is in a near-empty state (St03). When the adhesive container 10 is determined to be in a near-empty state by the signal from the sensor 22*a*, adhesive is charged to the charging compartment 10*b* (St04). The refilling amount of adhesive in this initialization process is preset. The adhesive in the adhesive tub 10*a* is set to "maximum refilling amount" to become Lmax. At the same time as adhesive is being charged to the container, the heating means 20 melts the solid adhesive in the charging compartment 10*b* to a predetermined temperature. Note that by the control motor M3 rotating the measuring drum 57 of the adhesive supply means 55 only a preset rotating amount, the supply of adhesive to the charging compartment 10*b* is the "maximum refilling amount."

With such an initialization action, the temperature of the adhesive in the adhesive container 10 is raised to a predetermined degree, and adhesive is stored in the adhesive tub 10*a* to the amount that there is no near-empty state (Lmin). Note that near-empty (Lmin) is the maximum amount of adhesive consumed to ensure an adequate amount of adhesive needed for at least one sheet bundle (maximum size; maximum thickness), and is preset to an amount of adhesive that can be applied to the sheet bundle. This is so that the adhesive in the container does not enter an empty state while it is being applied to the sheet bundle.

Next, the finishing mode (bookbinding process mode and the like), the number of copies, and the sheet size are set (St06). An operator uses a control panel, which is an image-forming system, described below, to input the number of booklets to be created and the sheet sizes for these settings.

Based on these settings, sheets printed with images at the image-forming device (St07) are collated and stacked into sheet bundles on a stacking tray (St08). The collated and stacked sheet bundle is shifted to the adhesive application position. Here, the drive motor M2 is driven to reciprocate the adhesive container 10 along an edge of the sheet bundle. At the same time, the stirring motor M1 is rotated to rotate the applicator roller 30. In the outward movement of the adhesive container 10, the edges of the sheets are separated, and a predetermined amount of adhesive is applied to the sheet bundle in the inward movement. The amount of adhesive applied at this time is adjusted by the gap (g shown in FIG. 2) between the applicator roller 30 and the sheet bottom edge SU. If this gap g is set to be large (separated a predetermined distance), the amount of adhesive is low per units of surface area; if this gap g is set to be small (a near distance), the amount of adhesive is higher per units of surface area.

Here, if the sheet bundle is thick, the amount of adhesive per unit area is large, or the amount of adhesive is adjusted depending on the sheet material. In other words, for sheet bundles that are difficult for the adhesive to penetrate between the leaves of sheets because the sheet bundle is thick or because of the material of the sheets (for example coated sheets), the cap is set to be low, and the adhesive amount is set to be higher.

When the operation for coating the sheet bundle is ended, the refill volume control means 61 monitors detection signals from the sensor 22*a* for the amount of adhesive in the adhesive tub 10*a* (St10). Monitoring of the adhesive amount is described below. The control CPU60 executes the bookbinding process (St11) and conveys the finished sheet bundle to the storage stacker. (St12) There, the control CPU60 calculates the remaining number (St14), then returns to step St07 to perform the same processes on subsequent sheets.

When the processes are repeated to apply adhesive for the set number of sheet bundles (N) ("Yes" at St13), then all processes are ended (St15).

Refill Amount Control Means Configuration

The refill volume control means 61 that is composed of the control CPU60, as described above, detects the amount of adhesive in the adhesive tub 10*a* at the point where the adhesive is applied to the sheet bundle (St10 above). With this detection, adhesive is refilled, as shown below, when a near-empty state is detected. The refilling of the adhesive can be performed according to either one of embodiment 1, embodiment 2 or embodiment 3, described below.

Figure 9A:
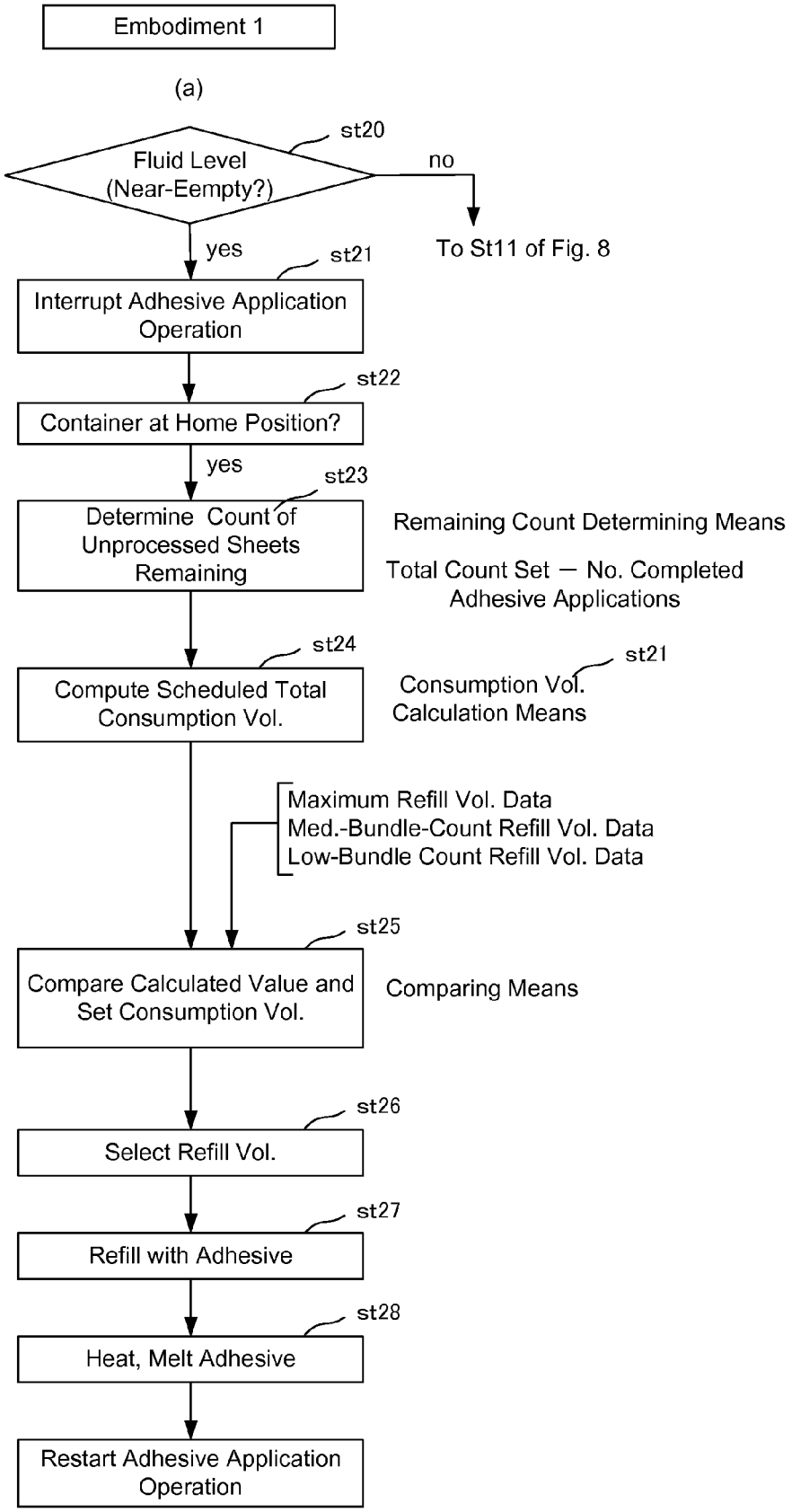
FIG. 9A is a first embodiment.

The first refilling method sets a plurality of refilling amounts that differ in levels for the amount of adhesive pre-filled, and one is selected with the remaining number of unprocessed sheets. As shown in FIG. 9A, the remaining number of unprocessed sheets (St21) is determined when a near-empty state is determined by the refill volume control means 61 with a detection signal from the adhesive sensor 22*a* (St20). This determination is done by remaining sheets determining means 62. The remaining sheets determining means 62 is configured to subtract the number of sheet bundles that have been coated with adhesive, from the "process number (N)" set at step 06, for example. In other words, at step 14, by executing "N−1," the number of remaining unprocessed sheets is subtracted.

Also, the refill volume control means 61 sets the plurality of refilling amounts that differ in levels, and stores that in memory means such as RAM and the like. The refilling amount is set in a plurality of levels such as "maximum refilling amount," "middle refilling amount," and "low refilling amount." At this time, the maximum refilling amount is set to an amount where the adhesive in the adhesive tub 10*a* shifts from a near-empty state (Lmin) to a full state (Lmax). The middle refilling amount sets the amount of adhesive to a ⅔ position in the adhesive tub 10*a*, and the low refilling amount sets the adhesive in the adhesive tub 10*a* to a ⅓ position.

There, the refill volume control means 61 selects one of either the "maximum refilling amount (Lmax)," the "middle refilling amount (Lm1," or the "low refilling amount (Lm2)" according to the number of unprocessed sheets to set the amount of adhesive to refill to the charging compartment 10*b*

(St22). The refill volume control means 61 is equipped with scheduled consumption amount calculation means 64 that calculates the scheduled consumption amount of adhesive (X×L) from the remaining number X of applications of unprocessed sheets and the adhesive amount (L) consumed for one sheet bundle. Based on this calculation result of the calculation means, the refilling amount is set to the maximum refilling amount when the calculated value exceeds the maximum refilling amount (Lmax).

Also, if the calculated value of the calculation means 64 exceeds the low refilling amount (Lm2), the refilling amount is set to the middle refilling amount (Lm1). In the same way, if the calculated value is less than the low refilling amount (Lm2), the refilling amount is set to the low refilling amount (Lm2). Note that the amount of adhesive consumed (L) for one sheet bundle in the scheduled consumption amount calculation means 64 is preset to the standard amount based on (1) the standard application amount, or (2) calculated by multiplying the sheet length by the total sheet bundle thickness (or number of sheets) of unprocessed sheets. In other words, the scheduled consumption amount calculation means calculates the consumption amount of adhesive used thereafter from the remaining number of applications of unprocessed sheets and the amount of adhesive consumed on one sheet bundle. Also, the refilling amount of adhesive is set based on this calculated value. Therefore, the calculation of the scheduled consumption amount can be an approximate estimate. The simplest method can be (1) above, or by using method (2) above, it is possible to set the refilling amount by accurately finding the consumption amount.

Based on the refilling amount set in this way, the maximum refilling amount (Lmax), the middle refilling amount (Lm1) or low refilling amount (Lm2) are used to refill the adhesive by controlling angle, number of rotations and the rotation of the measuring drum 57.

Embodiment 2

Figure 9B:
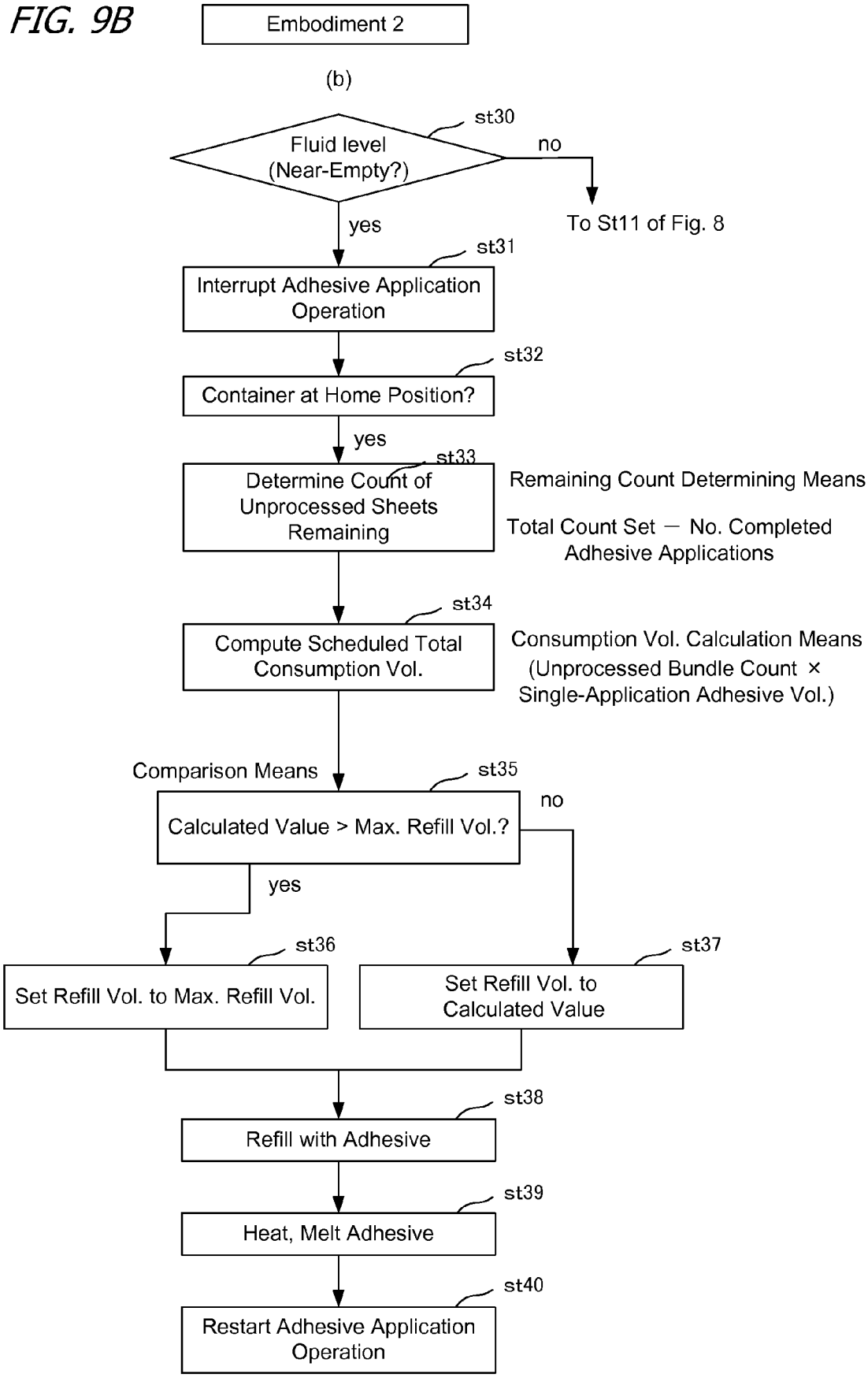
FIG. 9B is a second embodiment.

The second refilling method calculates the total consumption amount of unprocessed sheets and sets the refilling amount based on that calculated value. As shown in FIG. 9B, the remaining number of unprocessed sheets (St21) is determined when a near-empty state is determined by the refill volume control means 61 with a detection signal from the adhesive sensor 22*a* (St20). This determination is performed by the remaining sheets determining means 62; the remaining sheets determining means 62 has the same configuration as that described in relation to the first embodiment.

The "maximum refilling amount" where the adhesive is full in the adhesive tub 10*a* is preset in the refill volume control means 61. The refill volume control means 61 is equipped with calculation means 64 that calculates the scheduled total consumption amount of adhesive (X×L) from the remaining number X of applications of unprocessed sheets and the adhesive amount (L) consumed for one sheet bundle. Based on this calculation result of the calculation means, the refilling amount is set to the maximum refilling amount when the calculated value exceeds the maximum refilling amount (Lmax) (St21). For that reason, the refill amount control means 61 has comparing means 65 that compare the calculation results from the calculation means and a preset maximum refill amount.

Also, when the calculated value of the calculation means 64 exceeds the maximum refill amount, the adhesive refill amount is set to the calculated value (preset total consumption amount) calculated by the calculation means 64. (St21) The amount of adhesive consumed (L) for one sheet bundle in the scheduled consumption amount calculation means 64 is (1) preset to the standard amount based on the standard application amount, or (2) calculated by multiplying the sheet length by the total sheet bundle thickness (or number of sheets) of unprocessed sheets. For (2) above, either the standard application thickness (thickness of the adhesive layer) is multiplied by the total surface area (total bundle thickness×total application length) or multiples the application thickness set from the sheet material.

In this way, the scheduled consumption amount calculation means calculates the consumption amount of adhesive used thereafter from the remaining number of applications of unprocessed sheets and the amount of adhesive consumed on one sheet bundle. Also, the adhesive equivalent to this calculated value is refilled into the adhesive tub 10*a*. The refilling control controls the measuring drum 57 in the same way as described in relation to the first embodiment.

Image-Forming System Configuration

The overall configuration of the image-forming system will now be explained in relation to FIG. 4. The essential portion thereof is shown in FIG. 5. This system is composed of a printing unit C and the bookbinding unit A that binds into booklets printed sheets conveyed from the printing unit C. A stacker D that stores unbound printed sheets is installed next to the bookbinding unit A. This printing unit C is composed of a known structure such as a printer or photocopier and the like. A predetermined sheet is kicked out of a cassette in a feeder unit 40 and is printed by a printing drum 41. After the image is fused to the sheet by a fuser 42, then conveyed out from a discharge outlet 43. The printing drum 41 in the drawing is a photoreceptor drum. This uses a static electric printing method that forms a static electric latent image on the surface of the drum using a laser oscillator and transfers that image to the sheet. Other printing methods such as a silk screen printing method, ink-jet printing method can be adopted.

Printed sheets sequentially output from the discharge outlet 43 are collated into a predetermined number of sheets and aligned at the stacking tray 44 in the bookbinding unit A. The symbol 45 in the drawing denotes a sheet conveyance-in path that guides the printed sheets from the discharge outlet 43 to the stacking tray 44. Sheets collated and aligned on the stacking tray 44 are conveyed to the adhesive application position E by gripping conveyance means 46. Of particular note, the stacking tray 44 is disposed to be in a substantially lateral orientation; the bookbinding path 47 that conveys the sheet bundle using the gripping conveyance means 46 is disposed to be substantially longitudinal. The gripping conveyance means 46 is composed of a pair of gripping means that nip the sheet bundle at its front and back sides and change the orientation of the sheet bundle from a lateral state to a longitudinal state and convey the sheet bundle in a longitudinal direction along the bookbinding path 47.

Also, a cover sheet conveyance path 48 that conveys a cover sheet is connected to a sheet conveyance-in path 45; a sheet conveyance-out path 49 is connected to the cover sheet conveyance path 48. In other words, a printed sheet conveyed from the discharge outlet 43 of the printing unit C is conveyed from the sheet conveyance-in path 45 to the stacking tray 44, and a cover sheet conveyed from the discharge outlet 43 is supplied to the cover sheet conveyance path 48 that branches from the sheet conveyance-in path 45. At the same time, printed sheets that do undergo the binding operation are conveyed from the discharge outlet 43 through the sheet conveyance-in path 45, cover sheet conveyance path 48 and into the stacker unit D from the sheet conveyance-out path 49, traversing the bookbinding unit A.

The bookbinding path 47 and cover sheet conveyance path 48 are disposed to mutually intersect each other. The sheet bundle conveyed from the bookbinding path 47 and the cover sheet conveyed from the cover sheet conveyance path 48 are joined at the cover sheet binding position F (see FIG. 4). In other words, the cover sheet HS is conveyed to the cover sheet binding position F so that its center line is aligned to the intersecting point and the sheet bundle is touched to the cover sheet in an upside-down T-shape from the bookbinding path 47 that is perpendicular to the sheet bundle. Folding rollers 53*c* disposed in the bookbinding path 47 downstream of the cover sheet binding position F fold the cover sheet to encase the sheet bundle. The adhesive application unit B is built-in upstream of the cover sheet binding position F.

The sheet bundle sandwiched by the gripping conveyance means 46 and held in an upright orientation at the adhesive application position E so that its bottom edge is coated with predetermined amount of adhesive. The adhesive container 10 explained with references to FIGS. 1 to 3 in the adhesive application unit B is capable of moving along the bottom edge SU of the sheet bundle. The adhesive container 10 provided the heating means 20 has the same configuration as was described above. Therefore, an explanation thereof will be omitted.

Explanation of Bookbinding Operation

Figure 6A:
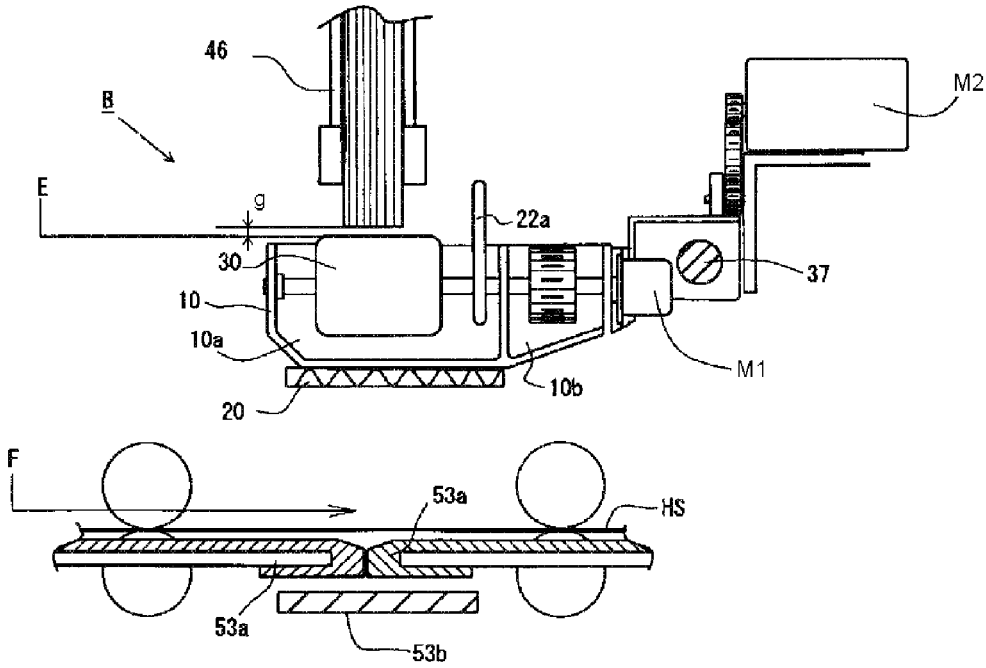
FIGS. 6A and 6B are explanatory views of a bookbinding operation in the system shown in FIG. 4; 6A shows a state of adhesive being applied; 6B shows a state where the sheet bundle coated with adhesive being joined to a cover sheet.
Figure 6B:
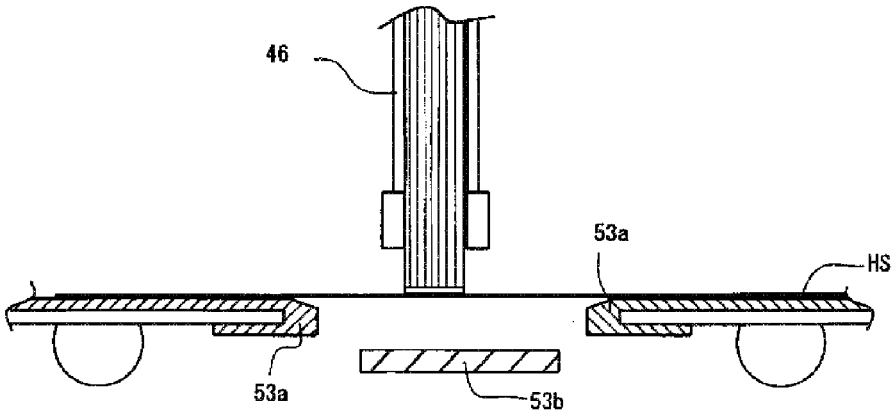
Figure 7A:
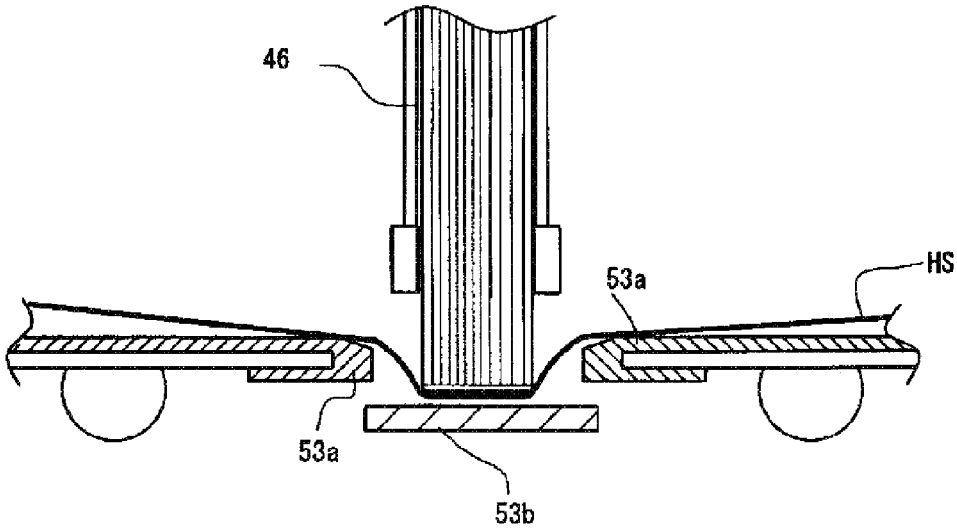
FIGS. 7A and 7B are explanatory views of the bookbinding operation in the system shown in FIG. 4; 7A shows an initial state of the sheet bundle and cover sheet being bound; 7B shows a state where the cover sheet is being folded over and covering the sheet bundle.
Figure 7B:
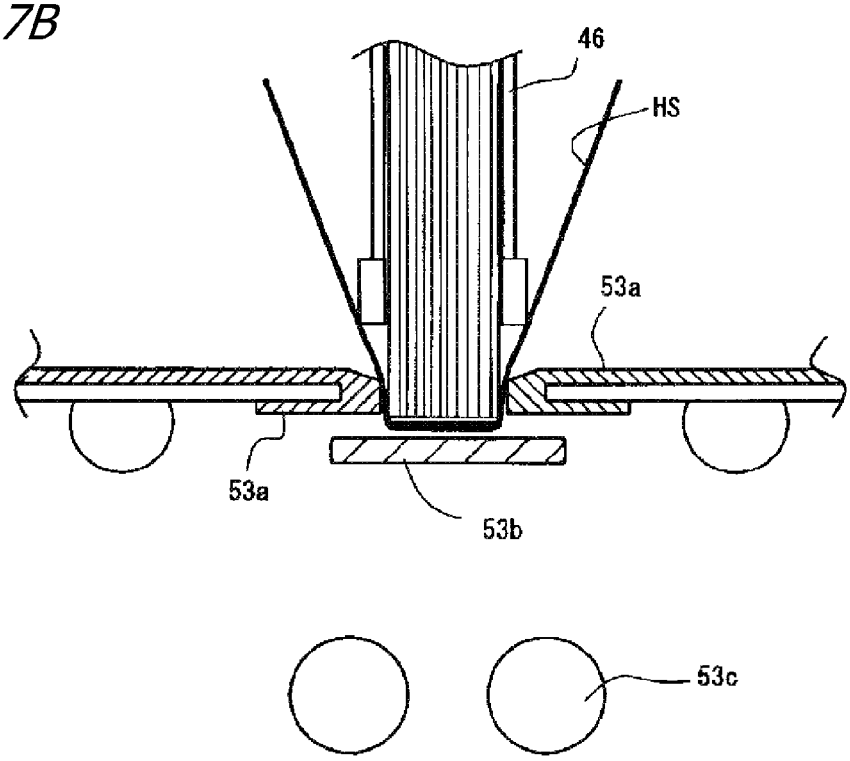

The bookbinding unit A configured as described above and bookbinding operations will now be explained with references to FIGS. 6 and 7. As shown in FIG. 6A, the adhesive container 10 is supported on the guide rail 37 and driven by the drive motor M2 to move along a longitudinal direction of the sheet bundle held by the gripping conveyance means 46.

The adhesive container 10 can move in the longitudinal direction along the spine portion of the sheet bundle (a direction orthogonal to the bundle thickness) and the applicator roller 30 built-in to the adhesive container 10 is rotated in a predetermined direction, for example in a direction reverse to the adhesive container 10 direction of movement. Adhesive on the applicator roller 30 is applied to the spine portion of the sheet bundle (see the state shown in FIG. 6A). Next, after the coating process, the adhesive container 10 is retreated to its outside home position HP from the conveyance path of the sheet bundle in the state shown in FIG. 6B.

The sheet bundle coated with adhesive is conveyed to the cover sheet binding position F by the gripping conveyance means 46 and is joined to the cover sheet HS fed from the cover sheet conveyance path 48. (See the state shown in FIG. 7A.) After both are joined, spine folding pressing means 53*a* disposed in the cover sheet binding position F fold the cover sheet. (See the state shown in FIG. 7B.) Then, the sheet bundle is bound into a booklet by the folding rollers 53*c*, and when necessary, a trimming unit 50 downstream of the folding rollers 53*c* trims true edges of the bound sheet bundle. Note that 53*b* denotes a spine pressing plate disposed in the cover sheet binding position F. This is configured to project into and retreat from the bookbinding path 47. Then, the sheet bundle bound with a cover sheet is stored in a storage stacker 51.

Note that in the foregoing embodiment, an explanation was provided for the cover sheet HS to be conveyed in the same way as a printed sheet from the discharge outlet 43 after it has been printed with a title and the like at the printing unit C, but it is also acceptable to install an inserter between the printing unit and bookbinding unit A to supply the cover sheet HS from the inserter to the sheet conveyance-in path 45. The inserter can be composed of one or a plurality of trays, a separating roller to separate sheets on the tray into single sheets, and a sheet supply path to guide the sheet from the separating roller to the sheet conveyance-in path 45.

Also, the stacker unit D is composed of a discharge tray that sequentially stacks and stores sheets conveyed from the conveyance outlet 52 of the sheet conveyance-out path 49 connected to the cover sheet conveyance path 48. This unit can also be equipped with a finishing unit to staple, punch holes or apply marks to sheets conveyed from the conveyance outlet 52. This finishing unit can also adopt any known and preferred mechanisms.

Configuration of Control Means

Figure 10:
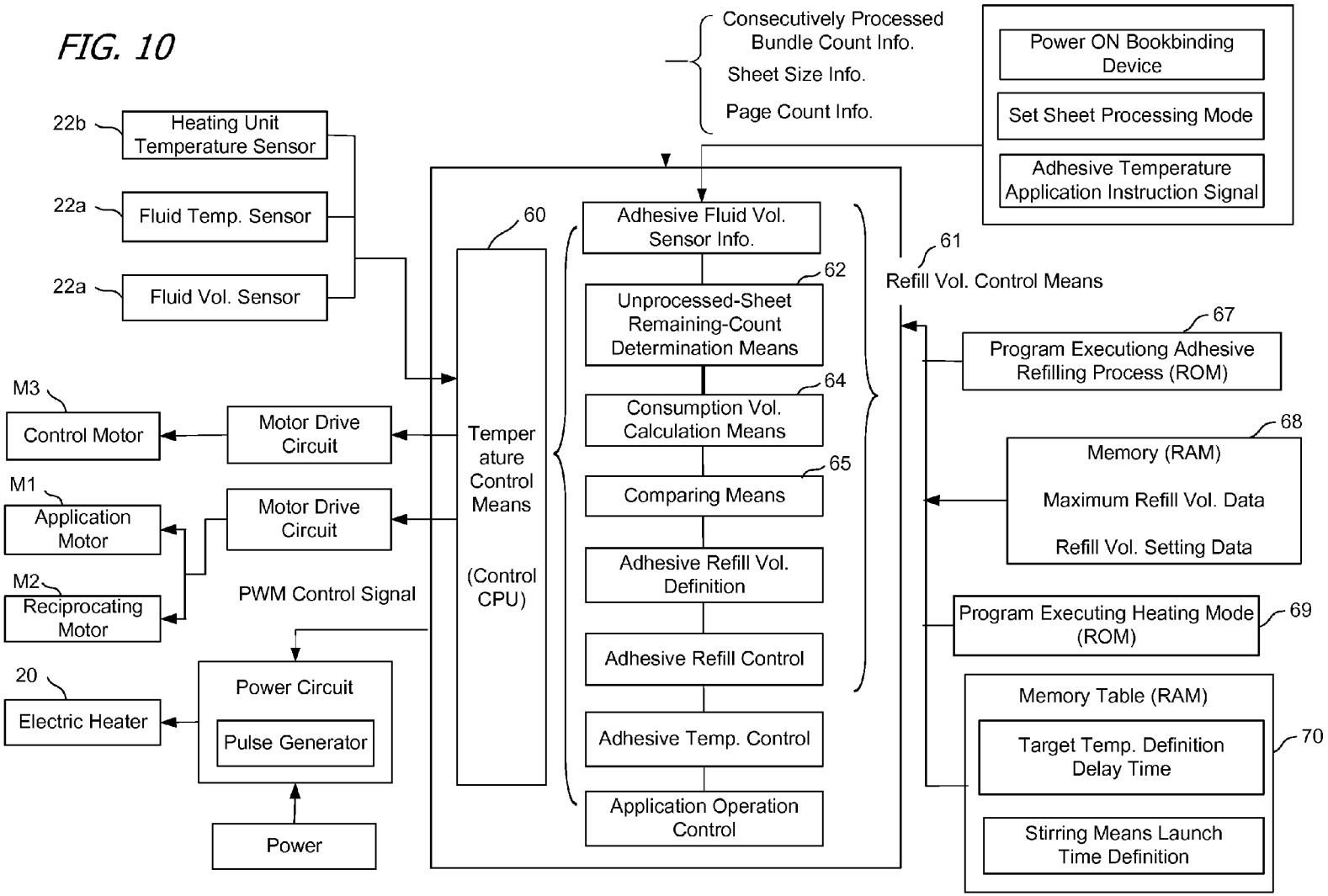
FIG. 10 is a block diagram showing a configuration of control means in the system shown in FIG. 4.

The following will explain the control of the image-forming system described above. FIG. 10 is a block diagram of a control configuration of the bookbinding unit. The control unit of the bookbinding unit is composed of a control CPU60. The control CPU60 runs bookbinding process operations by loading programs that run the bookbinding processing operation from ROM (not shown). An adhesive refilling control program 67 and temperature control program 69 that controls the temperature of the adhesive are included in the ROM. Control data required for each control are stored in ROM. Control data 68 relating to adhesive refilling and control data 70 relating to temperature control are included in RAM.

The adhesive sensor (liquid temperature sensor and liquid amount sensor) 22*a* and heating unit temperature sensor 22*b* are connected to the control CPU60. These are configured to send detection signals thereto. Also, a position sensor 59S (not shown) that detects the encoder 59 is connected to the control CPU60.

The application motor (stirring motor) M1, drive motor M2 and control motor M3 are linked to control CPU60 via a drive circuit to control drive. Furthermore, the control CPU60 composes the remaining sheets determining means 62, scheduled consumption amount calculation means 64, and the comparison means 65. The remaining sheets determining means 62 receives information of the number of units to be processed from the image-forming unit and each time adhesive is applied to the sheet bundle, a unit is subtracted (N−1) from the total number of processes (N). The scheduled consumption amount calculation means 64 is configured to calculate the scheduled consumption amount of unprocessed sheets from the sheet size information received from the image-forming unit and page count information. This calculation find the total application length from the sheet size information by calculating the total page thickness from the total number of pages of unprocessed sheets. Also, by multiplying (number of remaining unprocessed sheets), (total bundle thickness) and (total application length) by (standard adhesive application layer thickness), it is possible to calculate the total amount of adhesive that will be consumed thereafter.

The comparison means 65 is composed by a comparator that compares a calculation value of the preset maximum refilling amount of adhesive and the scheduled consumption amount calculation means 64.

This application claims priority rights from Japanese Pat. App. No. 2007-305739, which is herein incorporated by reference.

What is claimed is:

1. An adhesive applicator for a bookbinding device, the adhesive applicator for sequentially applying an adhesive to a spine-portion endface of consecutively fed sheet bundles, and comprising:

an adhesive holding container for storing adhesive;

an applicator roller rotatably disposed inside said adhesive holding container;

adhesive supply means for refilling said adhesive holding container with hot-melt adhesive;

heating means for melting adhesive inside said adhesive holding container;

refill volume control means for controlling the volume of adhesive resupplied by said adhesive supply means;

adhesive-volume detection means provided in said adhesive holding container; and remaining-count determination means for determining a count of adhesive-application instances remaining for to-be-coated sheet bundles; wherein said refill volume control means is configured to preestablish the adhesive refill volume based on information from said adhesive-volume detection means and remaining-count determination means, said refill volume control means therein being furnished with a scheduled-consumption-volume calculation means for calculating a scheduled adhesive-consumption volume from the count, from said remaining-count determination means, of sheet-bundle adhesive applications remaining, and from the application volume of adhesive applied to a single sheet bundle.

2. The bookbinding-device-directed adhesive applicator according to claim 1, wherein said remaining-count determination means determines the count of sheet-bundle adhesive applications remaining from a gross count, through input means, of sheet bundles for processing, and from a coating-process-completed count of sheet bundles having been adhesive-coated by said applicator roller.

3. The bookbinding-device-directed adhesive applicator according to claim 1, wherein:

said refill volume control means is furnished with comparing means for comparing a set refill volume, having been established in advance, with the scheduled consumption volume from said scheduled-consumption-volume calculation means; and when in said comparing means the scheduled consumption volume is less than the set refill volume, said refill volume control means defines the adhesive refill volume based on the scheduled consumption volume.

4. The bookbinding-device-directed adhesive applicator according to claim 1, wherein said scheduled-consumption-volume calculation means is configured to calculate the scheduled adhesive-consumption volume from:

the count of sheet-bundle adhesive applications remaining; and either (1) a preestablished application volume with which a single sheet bundle is coated, or (2) an application volume with which a single sheet bundle is coated, calculated from information including extant-sheet-bundle size, number of sheets, bundle thickness, and sheet material.

5. An adhesive applicator for a bookbinding device, the adhesive applicator for sequentially applying an adhesive to a spine-portion endface of consecutively fed sheet bundles, and comprising:

an adhesive holding container for storing adhesive;

an applicator roller rotatably disposed inside said adhesive holding container;

adhesive supply means for refilling said adhesive holding container with hot-melt adhesive;

heating means for melting adhesive inside said adhesive holding container;

refill volume control means for controlling the volume of adhesive resupplied by said adhesive supply means;

adhesive-volume detection means provided in said adhesive holding container; and remaining-count determination means for determining a count of adhesive-application instances remaining for to-be-coated sheet bundles; wherein:

said refill volume control means is configured to preestablish the adhesive refill volume based on information from said adhesive-volume detection means and remaining-count determination means;

said refill volume control means has a plurality of defined refill volumes according to which preestablished adhesive volumes differ; and based on information from said remaining-count determination means, said refill volume control means selects one of the defined refill volumes to refill said adhesive holding container with adhesive.

6. A bookbinding device comprising:

a sheet bundle conveyance path that sequentially conveys collated and stacked sheet bundles;

an adhesive applicator of claim 1, disposed in the sheet bundle conveyance path, for applying adhesive to a spine portion of a sheet bundle; and a total number of sheets processed recognition means for determining a total number of consecutive sheet bundles that have been processed.

7. The bookbinding device according to claim 6, further comprising stacking means for collating and stacking into sheet bundles sheets sequentially conveyed, in the sheet bundle conveyance path, wherein:

said refill volume control means refills said adhesive holding container with adhesive based on detection signals from said adhesive volume detection means, and based on information from said remaining-count determination means while subsequent sheets are being stacked in said stacking means.

8. The bookbinding device according to claim 6, wherein the total number of sheets processed recognition means is configured to ascertain information using input information from input means through which is input the total number of sheet bundles to process or information transferred from another device.

9. The bookbinding device according to claim 6, further comprising sheet stacking means disposed upstream of the sheet bundle conveyance path for collating sheets into sheet bundles sequentially; wherein said heating means melts adhesive refilled from the adhesive refilling means while sheets are being stacked by the sheet stacking means.

* * * * *